US009502786B2

(12) United States Patent
Wang et al.

(10) Patent No.: US 9,502,786 B2
(45) Date of Patent: Nov. 22, 2016

(54) ELECTRICAL CONTACT ELEMENT

(71) Applicant: HARTING Electric GmbH & Co. KG, Espelkamp (DE)

(72) Inventors: Xiafu Wang, Espelkamp (DE); Nicole Spilker, Luebbecke (DE); Stefan Garske, Bad Essen (DE); Martin Schmidt, Luebbecke (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 14/895,869

(22) PCT Filed: Jul. 10, 2014

(86) PCT No.: PCT/DE2014/100242
§ 371 (c)(1),
(2) Date: Dec. 3, 2015

(87) PCT Pub. No.: WO2015/003692
PCT Pub. Date: Jan. 15, 2015

(65) Prior Publication Data

US 2016/0126643 A1 May 5, 2016

(30) Foreign Application Priority Data

Jul. 11, 2013 (DE) ..... 10 2013 107 352

(51) Int. Cl.
*H01R 4/10* (2006.01)
*H01R 4/20* (2006.01)

(52) U.S. Cl.
CPC ..... *H01R 4/20* (2013.01); *H01R 4/203* (2013.01)

(58) Field of Classification Search
CPC ..... H01R 4/185; H01R 4/188; H01R 43/048
USPC ..... 439/877, 879, 882; 174/84 C
See application file for complete search history.

(56) References Cited

U.S. PATENT DOCUMENTS 3,346,690 A * 10/1967 McNerney ..... H01B 1/02 174/77 R
5,658,163 A 8/1997 DeRoss ..... 439/424

(Continued)

FOREIGN PATENT DOCUMENTS

DE 1 135 072 8/1962
DE 1 164 532 3/1964

(Continued)

OTHER PUBLICATIONS

English translation of International Preliminary Report on Patentability issued in corresponding PCT Patent Appln. Serial No. PCT/DE2014/100242, dated Jan. 25, 2016, (8 pgs).

(Continued)

*Primary Examiner* — Phuong Dinh
(74) *Attorney, Agent, or Firm* — Hayes Soloway P.C.

(57) ABSTRACT

Disclosed is an electrical contact element for contacting an electrical strand conductor, wherein the electrical contact element has a connecting side and a plugging side. A splicing element is provided in a connecting sleeve that forms the connecting side so as to electrically contact an electrical strand conductor in a more effective manner. The splicing element is provided for the purpose of separating out the individual strands of the conductor, contacting as large as possible a surface of the individual strands and penetrating the surface of the strands during a squeezing or crimping action. The arrangement provides a reliable, electrical contact of strand conductors in which a surface of the individual strands that is not suitable for being contacted and is poorly conductive is penetrated.

20 Claims, 3 Drawing Sheets

(56) References Cited

U.S. PATENT DOCUMENTS

| | | | | |
|---|---|---|---|---|
| 6,220,902 | B1 | 4/2001 | Ivandic et al. | 439/805 |
| 7,500,868 | B2 * | 3/2009 | Holland | H01R 4/2412 439/427 |
| 2003/0068931 | A1 | 4/2003 | Swearingen et al. | 439/843 |
| 2005/0159041 | A1 | 7/2005 | Holliday | 439/500 |
| 2007/0287323 | A1 | 12/2007 | Colescott et al. | 439/421 |
| 2010/0206631 | A1 | 8/2010 | Peters et al. | 174/77 R |
| 2012/0329342 | A1 | 12/2012 | Sato | 439/866 |
| 2013/0045610 | A1 | 2/2013 | Drew et al. | 439/34 |

FOREIGN PATENT DOCUMENTS

| | | | |
|---|---|---|---|
| DE | 1 992 567 | 8/1968 | |
| EP | 0 147 218 | 12/1984 | H01R 4/24 |
| EP | 0 639 869 | 8/1994 | H01R 4/18 |
| GB | 528772 | 11/1940 | |
| GB | 1 347 234 | 2/1974 | H01R 11/08 |
| GB | 2 037 503 | 11/1979 | H01R 4/50 |

OTHER PUBLICATIONS

International Search Report issued in corresponding PCT Patent Appln. Serial No. PCT/DE2014/100242, dated Oct. 8, 2014, with translation (7 pgs).

German Office Action issued in DE 10 2013 107 352.2 (1 pg).

* cited by examiner

ELECTRICAL CONTACT ELEMENT

BACKGROUND OF THE INVENTION

The invention relates to an electrical contact elements.

Contact elements are required in order to produce an electrically conductive connection between two electrical conductors. Typically, one or multiple contact elements are received in a combined manner in an insulating body and thus form a plug connector.

The object of the electrical contact elements is on the one hand to produce a connection to a contact element of a mating plug connector. For this purpose, a plugging side of electrical contact elements of this type is embodied as a pin or socket contact. In each case, a socket contact can be plugged together with a pin contact and an electrical connection can be produced in this manner.

On the other hand, it is necessary for an electrical contact element of this type to produce a connection to an electrical conductor. For this purpose, the electrical contact element comprises a connecting side. There is a plurality of solutions in the prior art for the embodiment of the connecting side.

BRIEF DESCRIPTION OF THE PRIOR ART

DE 1 164 532 A discloses a reversible contact element for electrical plug devices having a plugging side and a connecting side. The connecting side is embodied as a simple soldering lug. An electrical conductor that is to be contacted can be soldered on to the soldering lug that is embodied as a connecting link.

DE 1 135 072 B discloses a flat contact element for electrical plug devices that for the purpose of producing the plug connection to its mating contact element is brought together at an angle of 90°. The contact element that is embodied as a bending sheet metal part comprises on its connecting side multiple sheet metal connecting links that are provided so as to crimp an electrical conductor that is to be connected thereto.

DE 1 992 567 U1 discloses a contact element that is embodied from a solid material and is provided with a connecting pin or plug socket, said contact element being suited for fastening in an interlocking and latching manner, in an easily detachable manner in chambers in insulating housing that is produced in a single part manner. The contact element comprises on its connecting side a line connecting part that is provided for a crimp connection to a line that is connected thereto.

Crimp connectors of this type have shown themselves to be particularly advantageous. The connecting side of the contact element is produced in a particularly simple and cost-effective manner and a contact to a corresponding crimping tool can be simultaneously produced above all in a simple and rapid manner. This offers above all a particular advantage with respect to a soldered connection as in DE 1 164 532 A as described in the introduction in terms of the flexibility with regards to assembling and connecting a conductor to the contact elements.

The disadvantage in the case of alternative solutions known from the prior art relating to solder connections is that these solutions are not suitable for aluminum conductors. It is known that aluminum oxidizes immediately upon exposure to air. The layer of oxide that forms on the aluminum during oxidization restricts the electrical conductivity.

The contact of an electrical conductor that is embodied from aluminum is consequently not sufficient for the connecting possibilities that are known from the prior art. The electrical conductor is crimped and the layer of oxide between the electrical conductor and the connecting side of the electrical contact is compressed by means of a crimp connection.

Above all in the case of contacting aluminum conductors that comprise a plurality of fine strands, a good electrical contact can no longer be ensured as a result of the many layers of oxide on the individual strands.

SUMMARY OF THE INVENTION

The object of the invention is to embody an electrical contact element in such a manner that it is possible to ensure a reliable and electrically conductive contact of aluminum conductors.

The invention relates to an electrical contact element that is provided so as to contact and to electrically connect an electrical conductor. Expediently, the electrical contact element comprises a plugging side and a connecting side.

The plugging side of the electrical contact element—as is previously disclosed multiple times in the prior art—is embodied as a pin contact or socket contact. It is thus possible to produce an electrically conductive plug connection by means of bringing together an electrical contact element having a pin contact and a further electrical contact having a socket contact.

The connecting side of the electrical contact element is formed as sleeve shaped and forms a connecting sleeve. In this connecting sleeve it is possible for an electrical conductor to be inserted and to be crimped by means of a so-called crimping tool in the connecting sleeve. This type of crimp-connection is disclosed in multiple cases in the prior art.

The present invention is provided specifically for electrical conductors that are embodied from aluminum and comprise a plurality of strands. For this purpose, the electrical contact element comprises a splicing element that is provided in the connecting sleeve of the electrical contact element. The splicing element comprises at least two splicing segments that are arranged distributed around the circumference of the inner side of the connecting sleeve.

The splicing segments are preferably tapered elements that are facing radially inwards. A form of wedge shape is particularly advantageous. The purpose of the splicing segments is to penetrate between the individual strands of an inserted electrical conductor during the squeezing action.

When penetrating between the individual strands of an aluminum conductor, the splicing segments break the layer of oxide that has formed on each individual strand of the conductor. A good electrical contact of the individual strands is thus ensured.

In a particularly advantageous embodiment, the surfaces of the splicing segments are provided with a rough surface. This rough surface is used to break the layer of oxide on the strands in a particularly effective manner.

The splicing element can comprise a different number of splicing segments depending upon the embodiment and diameter of the electrical contact element. A splicing element having six splicing segments is thus for example particularly advantageous.

In one embodiment variant, the splicing segments are produced as a single part directly with the connecting sleeve. Said splicing segments can be arranged as wedges that are formed on the inner surface in the connecting sleeve. When squeezing or crimping an electrical conductor in the connecting sleeve, the splicing segments are pressed between the individual strands of the conductor.

A further, advantageous embodiment provides the splicing element as a separate component. The splicing element comprises a base and the individual splicing elements are formed on said base. It is preferred that the splicing element is to be positioned in the connecting sleeve in such a manner that the base is displaced forwards in the connecting sleeve and the splicing segments protrude from the interior in the direction of the open end of the connecting sleeve but are however also received in the connecting sleeve.

When assembling an electrical contact element of this type having separate splicing elements, the splicing element is first of all to be pushed over the exposed strands of the electrical conductor. The splicing element makes the individual strands separate out in such a manner that said strands distribute themselves between the splicing segments.

The end of the electrical conductor can subsequently be pushed together with the plugged-on splicing element into the connecting sleeve. The splicing segments are subsequently further driven between the strands by means of squeezing the connecting sleeve with pliers or a special crimping tool. As a consequence, the layer of oxide on the surface of the strands is broken and an electrical contact of a plurality of strands is ensured.

In a preferred embodiment of the electrical contact element having a separate splicing element, a fastening means is provided that is used to fix the splicing element in the connecting sleeve. For this purpose, a connecting bore hole is provided between the plugging side and connecting side in the electrical contact element and it is possible for the fastening means to act upon the splicing element through said bore hole.

It is expedient to use a screw as a fastening element. Said screw can be pushed from the direction of the plugging side through the connecting bore hole and can engage in a corresponding thread in the base of the splicing element. The splicing element is thus prevented from being pulled out of the connecting sleeve.

In a further embodiment, grooves are provided on the outer surface of the connecting sleeve, said grooves extending around the connecting sleeve. Said grooves are provided so as to show the user where to apply a squeezing or crimping tool. A regular arrangement of the crimp position is important owing to the splicing segments in order to ensure as effective an electrical contact as possible.

In an additional advantageous embodiment, at least one marking is provided on the outer surface of the connecting sleeve. This marking is used so as to align a crimping tool. Crimping tools are usually embodied from multiple jaws that act upon the object that is to be crimped. Since it is not possible to exert force in a uniform manner over the entire circumference, force is thus introduced in sections.

As a result, either dents are pressed into the contact element or a polygon is pressed from for example a round form. A force is thus applied at multiple sites by the connecting sleeve onto the inner-lying conductor and this fixes said conductor.

The marking is provided in order as far as possible to center said force onto the splicing segments, said force not being applied in a uniform manner over the entire circumference. Said marking is attached in such a manner that the maximum force is applied to the splicing segments by accordingly applying the crimping tool.

So that the marking that is provided in the embodiment is also provided on the correct position on the connecting sleeve, it is necessary to insert the slicing element in the connecting sleeve in a non-rotatable manner. This can be achieved both by way of an additional bore hole in the connecting sleeve and a pin or a screw that engages through the bore hole into a recess in the base of the splicing element.

A guiding groove would also be feasible in cooperation with a guiding resilient element, said guiding groove and resilient element being provided in the splicing element and inner surface of the connecting sleeve. It is also possible to provide both the groove in the splicing element and the resilient element on the connecting sleeve as well as a reversed solution.

It is furthermore advantageous to provide the entire inner surface of the connecting sleeve with a rough to sharp-edged surface. It is thus possible when squeezing or crimping the connecting sleeve to roughen the strands of a conductor and break through the layer of oxide that is not in direct contact with the splicing segments.

In a specific embodiment of the electrical contact element in accordance with the invention, the splicing segments of the splicing element comprise a particularly advantageous form. The splicing segments are embodied so as to be wider in the region of the opening of the connecting sleeve than in the region that is facing the plugging side.

This form of the splicing segments is intended to crimp the individual strands of an electrical conductor in a more intense manner in the region of the connecting sleeve opening than in the region that is facing the plugging side. If a force acts upon a fastened electrical conductor, said force pulling said electrical conductor out of the connecting sleeve, the strands of the electrical conductor form a bung in the plugging side region and said bung can only be pulled through the narrow rear region with difficulty.

The invention relates to an electrical contact element for contacting an electrical strand conductor, wherein the electrical contact element comprises a connecting side and a plugging side. A splicing element is provided in a connecting sleeve that forms the connecting side so as to electrically contact an electrical strand conductor in a more effective manner.

The splicing element is provided for the purpose of separating out the individual strands of the conductor, contacting as large as possible a surface of the individual strands, and penetrating the surface of the strands during a squeezing or crimping action. The invention provides that the strand conductors are electrically contacted in a reliable manner, wherein a surface of the individual strands that is not suitable for being contacted and is poorly conductive is penetrated.

BRIEF DESCRIPTION OF THE DRAWINGS

An exemplary embodiment of the invention is illustrated in the drawings and is further explained hereinunder. In the figures.

DETAILED DESCRIPTION OF THE INVENTION

Figure 1:
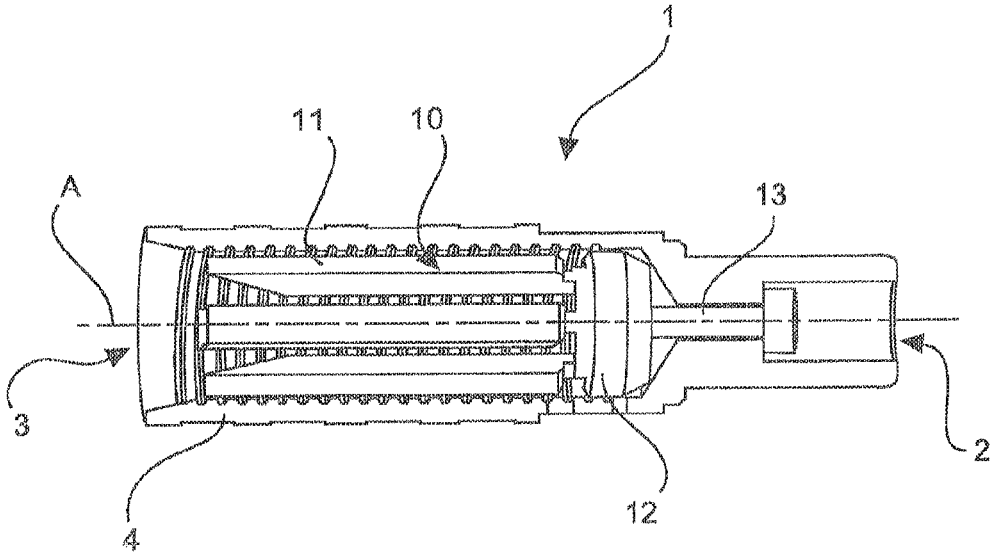
FIG. 1 illustrates a sectional view of an electrical contact element having a splicing element.

FIG. 1 illustrates an electrical contact element 1 in a longitudinal view along the longitudinal axis A. A plugging side 2 of the electrical contact element 1 is illustrated in the right region. A sleeve-shaped connecting side 3 is illustrated in the left region. The sleeve-shaped connecting side 3 is formed by a connecting sleeve 4.

In accordance with the present invention, a splicing element 10 is provided within the connecting sleeve 4. The splicing element 10 essentially comprises a base 12 and also multiple splicing segments 11. The base 12 is provided on the rearmost region in the connecting sleeve 4.

In order to prevent the splicing element 10 from falling out, said splicing element is fixed by means of a fastening means 13—in this case a screw—in the electrical contact element. In the specific embodiment that is illustrated, the screw is guided from the plugging side 2 through a bore hole 5 in the electrical contact element 4 and is screwed into the base 12 of the splicing element 10.

The splicing segments 11 of the splicing element 10 are distributed, facing away from the base 12, in the connecting sleeve 4. The splicing segments 11 extend over almost the entire length of the connecting sleeve 4 in an advantageous manner. In the illustrated embodiment—and also all the further figures—, the splicing element 10 comprises six splicing segments 11.

It is evident in the middle region of the splicing element 10 where the splicing segments 11 are attached to the base 12 that the material strength is less than the splicing segments 11 themselves. This advantageously provides a high degree of flexibility of the splicing segments 11 with respect to the base 12.

Figure 2:
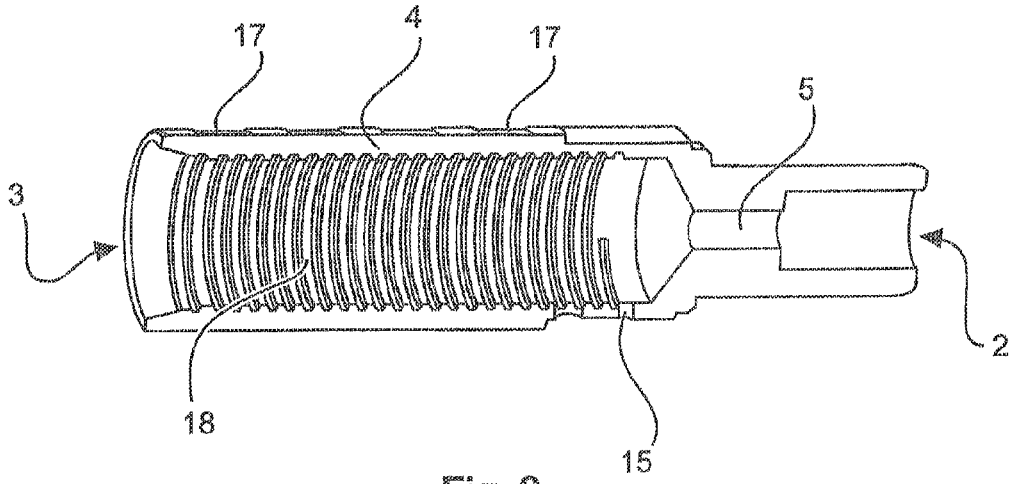
FIG. 2 illustrates a sectional view of an electrical contact element without a splicing element.

The electrical contact element 1 as in FIG. 1 is illustrated again in FIG. 2, however without the splicing element 10. The bore hole 5 that connects the plugging side 2 of the electrical contact element 1 to the connecting side 3 is easier to identify in this figure.

A thread-type contour is evident on the inner side 18 in the interior of the connecting sleeve 4 in FIG. 2. This advantageously sharp-edged contour is likewise used to break layers of oxide on strands that are inserted. The formation of a thread type contour is merely evident in an exemplary manner. All other types of sharp-edged contours are also suitable and expedient.

Four flat grooves 17 are evident on the outer side of the connecting sleeve 4. Said flat grooves are used to identify the crimping regions. Said grooves 17 indicate to the user the positions at which a crimping or squeezing tool is to be used.

Figure 3:
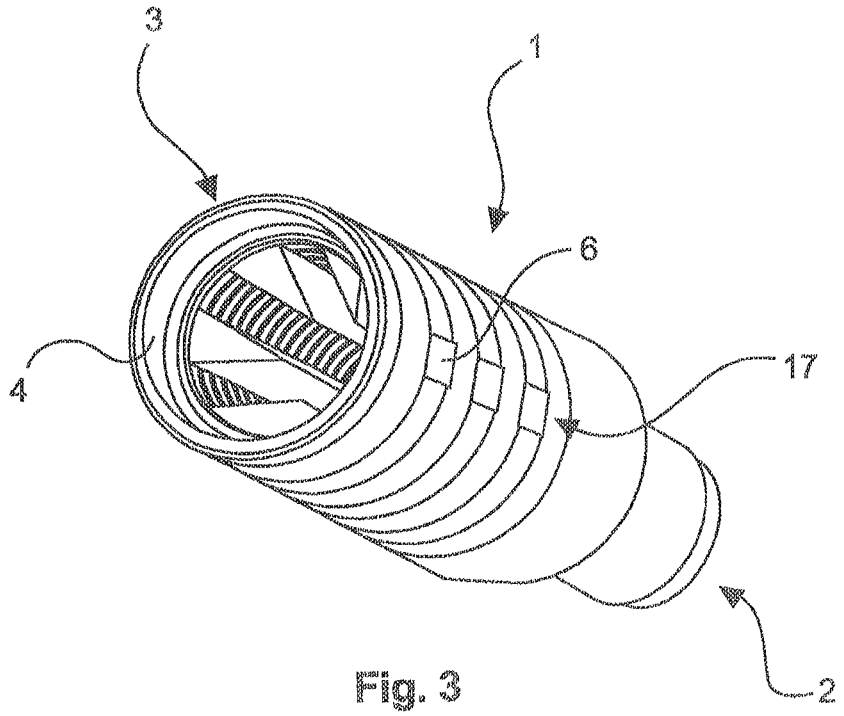
FIG. 3 illustrates an electrical contact element having a splicing element in a three-dimensional view.

FIG. 3 illustrates an electrical contact element 1 having a splicing element 10 in a three-dimensional view with a view of the connecting side 3. The four grooves 17 that extend around the connecting sleeve 4 are also evident in this case and said grooves are used as a marking for a crimping or squeezing tool.

In addition, three flat areas 6 can be identified between the grooves 17. Said flat areas are also used as markings for a crimping or squeezing tool. In contrast to the grooves 17, however, said flat areas are not used for the position along the electrical contact element 1 but rather for the angular position of the tool in the crimping region.

If a corresponding crimping tool that is tailored to the number of splicing segments 11 with its crimping jaws is used, the flat area 6 thus marks the position of a splicing segment 11 in the connecting sleeve 4. As a consequence, it is possible for the maximum force and squeezing action of the crimping tool to act precisely on those positions behind which in each case a splicing segment 11 is located.

Figure 4:
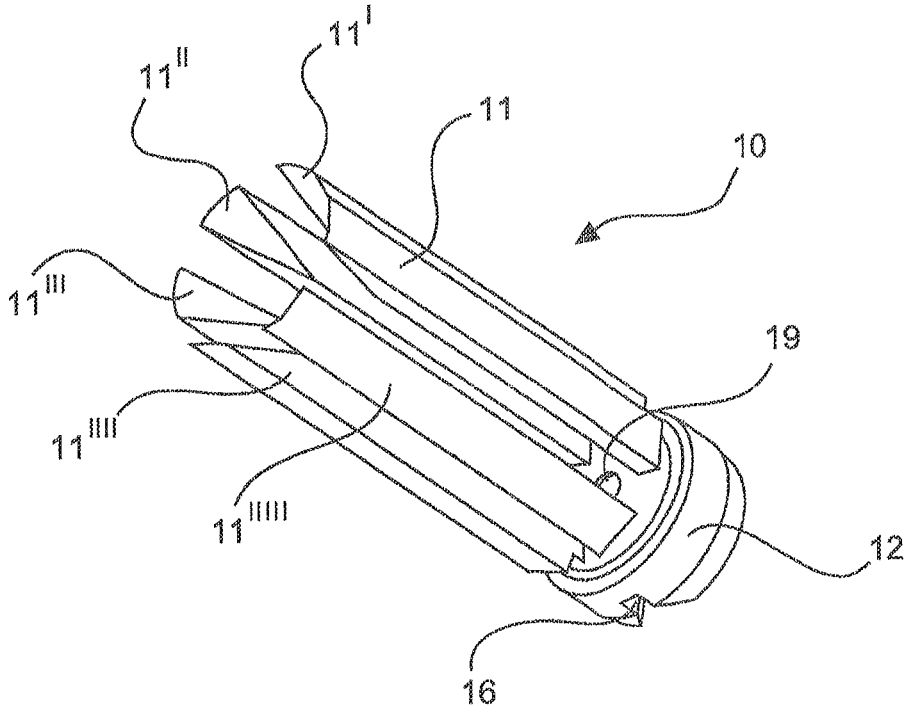
FIG. 4 illustrates an individual splicing element in a three-dimensional view.

FIG. 4 illustrates a splicing element 10 in a three dimensional view. As is already evident in FIG. 1, the splicing element 10 is embodied from a base 12 and the splicing segments 11, 11', 11", 11''', 11'''', 11''''' extend axially away from said base.

A thread 19 is evident in the base 12 and said thread is used to fix the splicing element 10 by means of a screw as a fastening means 13 in an electrical contact element 1.

The splicing segments 11 are tapered in the connecting side region on their inner side in order to simplify the process of plugging the splicing element 10 onto the strands of an electrical conductor 20.

In the base 12, the splicing element 10 comprises a bore hole 16. The bore hole 16 is embodied in the illustrated embodiment as a lateral slot. This lateral slot is used to hold the splicing element 10 in the receiving sleeve 4 in a non-rotatable manner. For this purpose, a further fastening element can be pushed into a bore hole 15 in the receiving sleeve 4. If the fastening means is guided through the bore hole 15 as far as into the bore hole 16, the splicing element 10 is prevented from rotating in the receiving sleeve 4.

Figure 5:
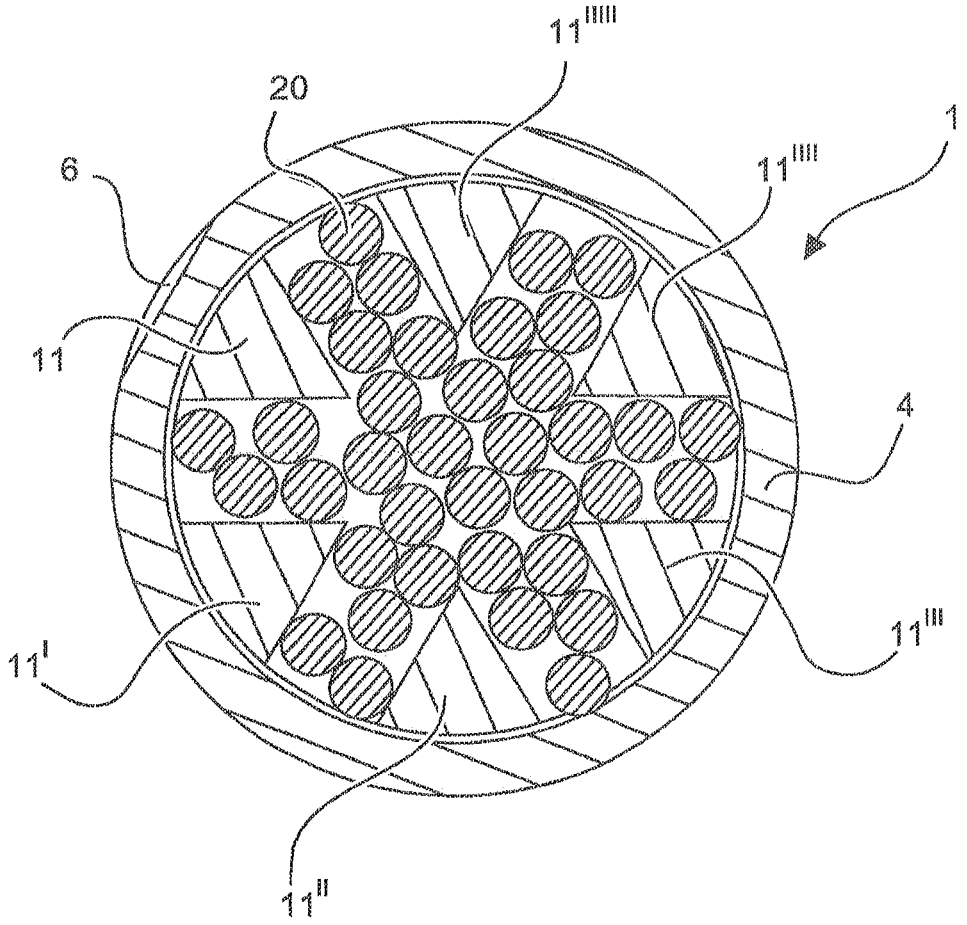
FIG. 5 illustrates an electrical element having an inserted electrical conductor in a sectional view.

FIG. 5 illustrates an electrical contact element 1 having an inserted electrical conductor 20 in a sectional view. The sectional view extends in a transverse manner through the electrical contact element 1.

The receiving sleeve 4 and also the splicing segments 11, 11', 11", 11''', 11'''', 11''''' accommodated therein which are distributed on the inner surface 18 of the receiving sleeve 4 around its circumference are evident.

Many individual strands are illustrated in the further, inner region of the receiving sleeve 4, said strands together forming the inserted electrical conductor 20. The individual strands are distributed between the splicing segments 11 so that a large part of the individual strands is advantageously in contact with one of the splicing segments 11. The higher the number of individual strands that are in contact with the splicing segments 11 or the inner surface 18, the higher the subsequent electrical contact.

In addition, the flat area 6 is evident in FIG. 5. Said flat area is used—as mentioned above- to provide a mark for a crimping or squeezing tool. The flat area 6 expediently lies directly outside a splicing segment.

LIST OF REFERENCE NUMERALS

1. Electrical contact element
2. Plugging side
3. Connecting side
4. Connecting sleeve
5. Bore hole
6. Flat area
10. Splicing element
11. Splicing segment
12. Base
13. Fastening means
15. Bore hole
16. Bore hole
17. Groove
18. Inner surface
19. Thread

The invention claimed is:

1. An electrical contact element for contacting an electrical conductor, wherein the electrical contact element is formed from a plugging side and a connecting side, wherein the plugging side is embodied as a contact socket or contact pin, wherein the connecting side is sleeve-shaped and forms a connecting sleeve of the electrical contact element, wherein a splicing element is provided in the connecting sleeve of the electrical contact element, wherein the splicing element is provided for the purpose of separating out individual strands of the electrical conductor, contacting as large as possible a surface of the individual strands and penetrating the surface of the strands during a squeezing or crimping action, and wherein the splicing element is formed from at least two splicing segments, wherein the splicing segments are embodied so as to be wider in a radial outer region in relation to a longitudinal axis (A) of the electrical contact element and embodied so as to be narrower in a radial inner region, and the splicing segments extend in a wedge-shaped manner in the radial inner region.

2. The electrical contact element as claimed in claim 1, wherein the splicing segments are arranged in the connecting sleeve distributed around a circumference of the connecting sleeve and preferably extend over the length of the connecting sleeve.

3. The electrical contact element as claimed in claim 2, wherein the surfaces of the splicing segments comprise rough surfaces.

4. The electrical contact element as claimed in claim 2, wherein the splicing segments extend over an outer half of the connecting sleeve radius.

5. The electrical contact element as claimed in claim 2, wherein the splicing segments extend in a region of the opening of the connecting sleeve further in the direction of the longitudinal axis (A) of the electrical contact element than in the region that is facing the plugging side.

6. The electrical contact element as claimed in claim 2, wherein the splicing segments of an inner surface of the connecting sleeve that form the splicing element are formed on and embodied as one part with the connecting sleeve.

7. The electrical contact element as claimed in claim 2, wherein the splicing element comprises a base, wherein the splicing segments are formed on the base, the base is arranged on the end of the connecting sleeve that is facing the plugging side, and the splicing segments extend in a perpendicular manner with respect to the plugging side away from the base.

8. The electrical contact element as claimed in claim 7, wherein the splicing element is provided as a separate part in the connecting sleeve.

9. The electrical contact element as claimed in claim 8, wherein the base of the splicing element can be fixed by a fastener in the connecting sleeve.

10. The electrical contact element as claimed in claim 9, wherein the fastener comprises a screw.

11. The electrical contact element as claimed in claim 8, wherein the fastener acts upon a base of the splicing element from the plugging side of the electrical contact element through a connecting bore hole and fixes the splicing element in the connecting sleeve.

12. The electrical contact element as claimed in claim 8, wherein the splicing element can be fixed by a further fastener in the connecting sleeve in a non-rotatable manner.

13. The electrical contact element as claimed in claim 12, wherein the further fastener comprises a pin or a screw.

14. The electrical contact element as claimed in claim 12, wherein the further fastener is pushed through a bore hole in the connecting sleeve to engage in a bore hole in the splicing element.

15. The electrical contact element as claimed in claim 1, wherein the connecting sleeve comprises a rough, preferably sharp-edged surface on an inner side.

16. The electrical contact element as claimed in claim 1, wherein the connecting sleeve comprises at least two grooves that extend around a circumference on the outer side.

17. The electrical contact element as claimed in claim 1, wherein the connecting sleeve comprises three grooves that extend around a circumference of the connecting sleeve.

18. The electrical contact element as claimed in claim 1, wherein the connecting sleeve comprises four grooves that extend around a circumference of the connecting sleeve.

19. The electrical contact element as claimed claim 1, wherein the connecting sleeve comprises at least one marking on the outer side, wherein the marking is preferably embodied as a flat area of an outer contour of the connecting sleeve.

20. The electrical contact element as claimed in claim 19, wherein the marking coincides in alignment on the connecting sleeve with a marking on one of the splicing segments on the inner side of the connecting sleeve.

* * * * *